United States Patent [19]

Cox et al.

[11] Patent Number: 4,758,760

[45] Date of Patent: Jul. 19, 1988

[54] CONVECTIVELY COOLED CERAMIC LAMP BASE

[75] Inventors: David A. Cox; Jeffrey P. Buschmann, both of Lexington, Ky.

[73] Assignee: GTE Products Corporation, Danvers, Mass.

[21] Appl. No.: 129,498

[22] Filed: Dec. 7, 1987

[51] Int. Cl.[4] ..... H01K 1/28; H01K 1/58

[52] U.S. Cl. ..... 313/43; 313/318; 313/579

[58] Field of Search ..... 313/579, 43, 318

[56] References Cited

U.S. PATENT DOCUMENTS 3,825,785 7/1974 Robinson ..... 313/43
4,568,854 2/1986 Westlund, Jr. et al. ..... 313/579

FOREIGN PATENT DOCUMENTS 475822 6/1915 France ..... 313/43
173986 1/1922 United Kingdom ..... 313/43
854514 11/1960 United Kingdom ..... 313/43

*Primary Examiner*—Palmer C. DeMeo
*Attorney, Agent, or Firm*—William E. Meyer

[57] ABSTRACT

A ceramic base for a tungsten halogen lamp has a bottom wall for supporting contact pins connected to respective lead-in wires sealed in the press-sealed end of the lamp. The base furthermore has a side wall integral with the bottom wall and at least one hole therein for receiving the press-sealed end of the envelope. The ceramic base side wall has convective vent passages including at least a first vent passage for inlet of cool air to the air space about the press-sealed end of the lamp, and at least a second vent passage for outlet of warmed air therefrom to thereby provide convective air cooling of the envelope press-sealed end.

12 Claims, 1 Drawing Sheet

CONVECTIVELY COOLED CERAMIC LAMP BASE

TECHNICAL FIELD

The present invention relates in general to tungsten halogen lamp bases in which the lamp envelope includes a press-sealed end. The present invention relates more particularly to a convectively cooled ceramic lamp base. The present invention is preferably employed in single ended tungsten halogen lamps and in particular in single contact mogul bi-post lamps.

BACKGROUND

In virtually all light sources such as tungsten halogen, incandescent, metal arc, etc., the electric energy is coupled to the lamp by means of conductors sealed into the glass envelope or bulb by means of a glass-to-metal seal. In the case of tungsten halogen lamps, the sealed end is typically press-sealed and is usually formed by having thin metal foil or wire pressed between the end's molten glass material. Because the metal and glass in contact with one another have different coefficients of expansion, they expand to different degrees upon heating. This expansion difference causes stress in the seal when heated and, generally, the greater the heating, the more stress that is imposed. Failure of a lamp seal in turn will cause failure of the lamp. The aforementioned heat not only causes the resulting stress but also causes accelerated oxidation of the parts (i.e., foils) exposed to air. Therefore, maintaining the press-seal at a cool temperature is a major consideration in the design and manufacture of lighting products such as these.

Most lamp seals are enclosed in a base that forms part of the lamp. The base not only protects the relatively sensitive seal area from physical damage, but also isolates the seal from the radiant energy given off by the lamp filament, or reflected from the lamp fixture.

There are primarily two types of lamp bases employed in tungsten halogen lamps. One such base is a formed metal base, as illustrated in U.S. Pat. No. 4,371,807. In addition, the assignee of this invention manufactures and sells single ended tungsten halogen lamps with metal bases having vent holes in the side walls of the metal base. The other form of base is a solid ceramic lamp base. Examples of tungsten halogen ceramic bases are illustrated in U.S. Pat. Nos. 4,243,907 and 4,568,854, both owned by the present assignee herein.

As indicated previously, the prior stamped metal base is provided with holes in the side wall, These bases are usually placed there using a punching operation. Such is necessary with a metal base, not only to help remove the heat added to the seal from conduction through the leads, but to cool the base itself. Because metal is an excellent heat conductor, radiant energy striking the base from the outside is immediately conducted to the inside of the base. The holes in the base help to minimize this heating effect. Because the metal itself is also sensitive to both heat and corrosion, the holes in the metal base also tend to cool the metal so as to protect the base itself.

Thus, there is a very definite advantage to having these holes for cooling purposes. However, there are also definite disadvantages. The holes in the base allow the passage of radiant energy to the seal area. Additionally, light and heat reflected from fixture optics and reflectors strike the seal and elevate its temperature.

Further disadvantages associated with a metal base include the fact that these are relatively expensive and also that they tend to be sensitive to corrosion over time.

The solid ceramic base protects the seal from radiant heating by sealing it off. This ceramic base has proven to be a very good insulator and is generally white or light in color, therefor, allowing no radiant heating effect. However, by enclosing the seal the ceramic base forms a nearly stagnant air pocket about the seal which allows for very little cooling of conducted heat. The heat conducted down the electrical leads from the lamp filament or heat source is trapped and not allowed to escape.

DISCLOSURE OF THE INVENTION

One object of the present invention, therefore, is to provide an improved tungsten halogen lamp and in particular a convectively cooled ceramic lamp base for such a lamp.

Another object of the present invention is to provide an improved tungsten halogen lamp base that not only inhibits radiant heating thereof but that which additionally also provides convective cooling of the lamp seal.

A further object of the present invention is to provide an improved tungsten halogen lamp base that is rugged in construction, can be manufactured relatively inexpensively, and is not sensitive to corrosion.

In accordance with one aspect of the invention, there is provided an improved tungsten halogen lamp, which is in particular characterized by an improved lamp base. The lamp is comprised of a sealed envelope of vitreous material having a bulb portion and a press-sealed portion at one end thereof. A pair of electrically conductive lead-in wires are sealed through the press-sealed portion and are disposed in spaced-apart relationship to one another. The lead-in wires are connected at their inner ends to a filament structure, which filament structure in turn is positioned within the bulb portion of the sealed envelope. The improved base construction in accordance with the present invention is comprised of a ceramic base having wall means defining at least one hole therein for receiving the press-sealed portion of the sealed envelope to support the envelope in the base. The ceramic base wall means has defined therein convective vent means including at least a first vent passage for inlet of cool air from external of the base to the base hole, and at least a second vent passage for outlet of warm air from the base hole to external of the base, whereby convective air cooling occurs of the envelope press-sealed portion. In this connection, the vent passages are spaced apart at the base hole with an air space being provided between the base hole and the press-seal portion of the lamp. The spaced placement of the vent passages include the second vent passage being disposed in the base wall means at a location closer to the envelope bulb portion than the location of the first vent passage so that warmed air automatically rises and is expelled out of the second vent passage enabling cooled air to enter via the first vent passage. The first and second vent passages preferably extend at an acute angle to the longitudinal axis of the base hole so as to maximize the radiant energy protection. In accordance with a preferred embodiment of the present invention the press-sealed portion includes a pair of spaced sealed legs each carrying a lead-in wire and foil seal. The ceramic base has a corresponding pair of holes disposed separately in the base and positioned to accommodate the sealed legs. In this embodiment, there are provided a pair of inlet vent passages disposed diametrically in the base side wall and communicating with respective base holes. Also, there are a pair of outlet vent passages disposed diametrically in the base side wall and communicating with respective base holes.

BEST MODE FOR CARRYING OUT THE INVENTION

For a better understanding of the present invention together with other and further objects, advantages and capabilities thereof, reference is made to the following disclosure and appended claims in connection with the above described drawings.

The present invention relates in general to electric lamps and particularly to high temperature tungsten halogen lamps and pertains, more particularly, to an improved lamp base construction that is described herein in association with a single contact, mogul bi-post lamp construction. The improved construction of the present invention provides for lower seal temperatures, particularly in comparison to prior art constructions such as the aforementioned metal base and all-ceramic base embodiments.

The ceramic base construction in accordance with the invention provides an optically dense construction so that the seal is not affected by radiant heat. Furthermore, the construction provides an efficient venting system using the natural properties of heated, expanding air to provide convective cooling air currents at the lamp seal. The base is preferably light colored and, due to the angle of the vents (to be described in further detail hereinafter), the construction is optically dense, not allowing light from the filament and heat to pass through to the seal.

Figure 1:
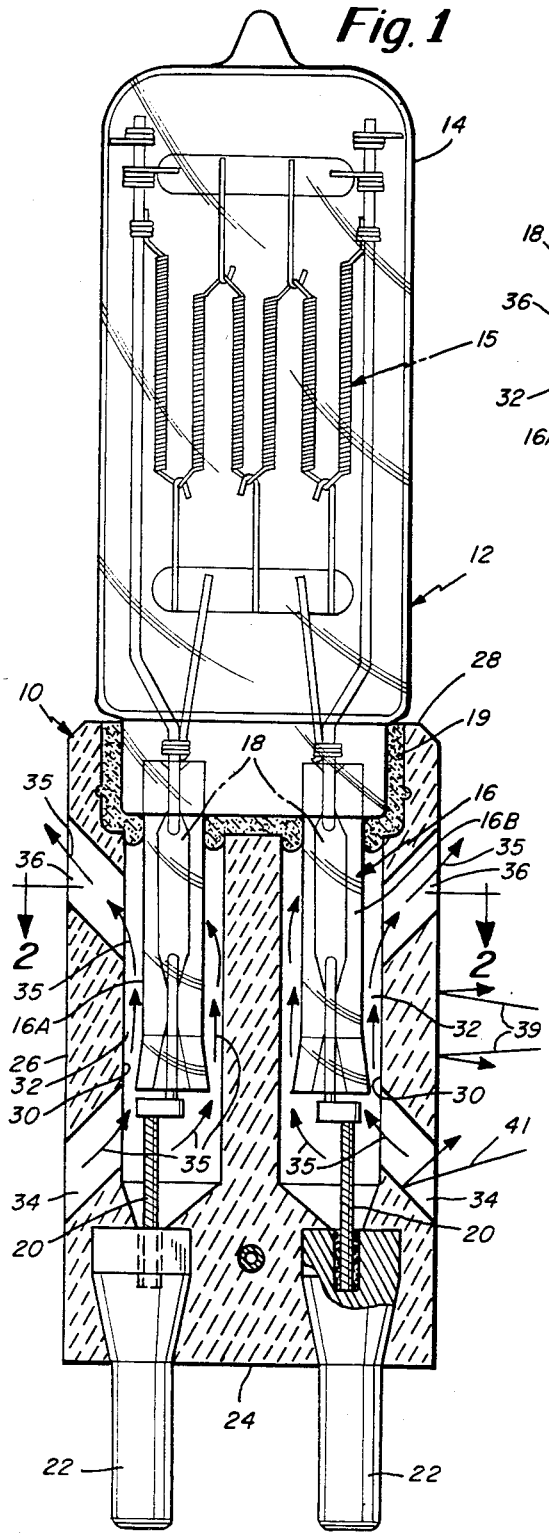
FIG. 1 is a longitudinal cross-sectional view illustrating a preferred embodiment of the tungsten lamp constructed in accordance with the principles of the present invention.
Figure 2:
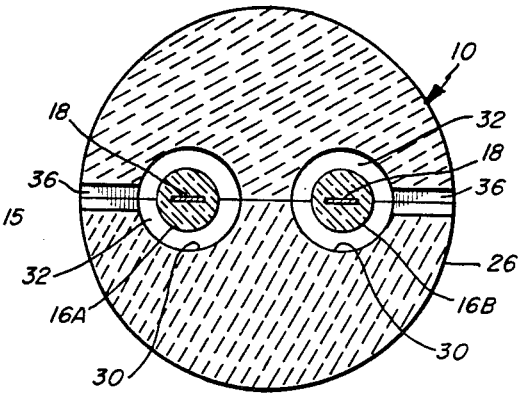
FIG. 2 is a cross-sectional view taken along line 2—2 of FIG. 1.

Referring now to the drawings, there is illustrated a tungsten halogen lamp of the single contact mogul bi-post type and incorporating the improved base construction. FIG. 1 illustrates the lamp as being comprised of base 10 for supporting the lamp envelope 12. The lamp envelope 12 has a bulb portion 14 (typically cylindrically shaped) and a press-sealed end portion 16. The press-sealed portion 16 is oriented at the bottom of the envelope when the lamp is in its usual operating position (illustrated in FIG. 1). FIG. 1 also illustrates a filament structure 15 supported in a conventional manner within the bulb portion of the envelope.

The envelope press-seal portion 16, in the particular embodiment described herein, is comprised of separate press-sealed solid glass legs 16A and 16B. Each of the press-seal legs carries lead-in wires including, as illustrated in FIG. 1, the molybdenum foil strips 18 which serve to interconnect the illustrated conductive lead wires. The use of such strips is of course well known in the art of tungsten halogen lamps, with examples being shown and described in U.S. Pat. Nos. 3,431,540 4,243,907.

Associated with each of the solid glass sealed legs 16A and 16B are respective end lead wires 20 received in respective hollow metal pins 22. The lead wire 20 and pin 22 construction is considered conventional. The hollow pins 22 are conventionally supported within the ceramic base 10.

Figure 3:
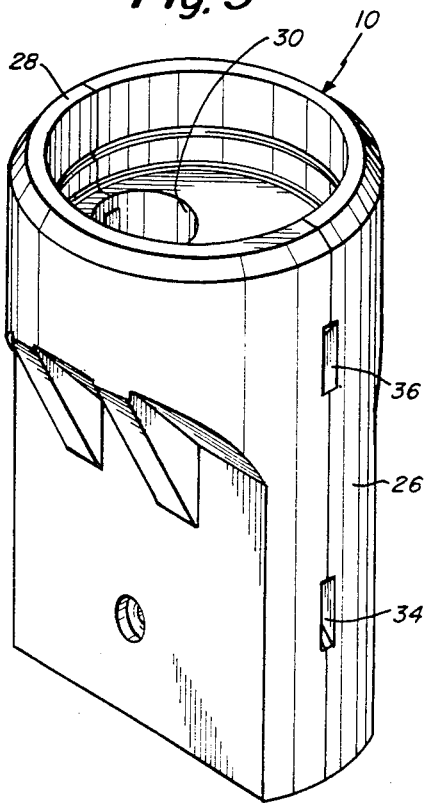
FIG. 3 is a perspective view of the ceramic lamp base of the invention as taken from the top end thereof.

Reference is now made in particular to the perspective view of FIG. 3 regarding further details of the ceramic base 10. The ceramic base 10 is constructed in two halves that are joined together in a conventional manner and cemented about the envelope (as illustrated by the cement 19 in FIG. 1). The ceramic base 10 has a bottom wall 24 with passages therein for receiving hollow pins 22. The base 10 also includes a side wall 26 terminating at its top end at rim 28 as illustrated in FIG. 3. The ceramic base is provided with a pair of holes 30 for receiving the corresponding glass sealed legs 16A and 16B. It is noted that the dimension of the sealed legs in comparison to the diameter of the holes 30 is such as to provide an annular air space 32 therebetween.

Now, as in accordance with the present invention, the side wall 26 of the ceramic base 10 has defined therein convective vent means, essentially one associated with each of the press-sealed legs. The cross-sectional view of FIG. 1 illustrates these vent means on diametrically opposite sides of the ceramic base and communicating with their respective air spaces 32 about the press-sealed legs. The vent means includes, on either side, an inlet vent passage 34 and an outlet vent passage 36. The passage 34 is for inlet of cool air from external of the base, coupling the air into the corresponding base hole. The vent outlet passage couples warmed air from the base hole to external of the base. In this way a convective air cooling occurs of the envelope press-seal portion. In this regard heat generated by the lamp and conducted through the press-sealed legs heats the air in the air space 32 surrounding the legs. This warmed air tends to rise and escape through the top outlet vent passages, namely the vent passages 36 illustrated in FIG. 1. Cooler external air enters (is drawn in) through the bottom inlet vent passages 34 to replace the air passing out the upper outlet vent passages 36.

With further reference to FIG. 1, it is noted that the inlet and outlet vent passages are preferably arranged in the geometric configuration illustrated. In other words, these vent passages are disposed at an acute angle to the longitudinal axis of the lamp base. In the embodiment illustrated in FIG. 1 the vent passages are disposed at approximately 45° to the longitudinal axis of the lamp base. The inlet vent passage 34 is disposed near the bottom end of the legs 16A and 16B and the outlet vent passage 36 is disposed adjacent to the top ends of these same legs. The convective air flow is caused by heating expanding air forming a convective air flow across the seals. This is illustrated in FIG. 1 by the air flow indicated by arrows 35.

The angular vent passages 34 and 36 are arranged so as to also optimize radiant energy reflections. Note in FIG. 1 the arrows 39 illustrative of the ceramic base construction as it inhibits radiant energy and radiant heating. With the vent passages 34 and 36 at an angle, this radiant energy is also substantially inhibited from passing directly to the lamp seal. Any radiant energy (light) entering the passage but not reflected from an external surface of the ceramic base is instead reflected, as indicated by the arrow 41 in FIG. 1, from an internal surface defining the vent passage. In addition to being disposed angularly, these vent passages also preferably converge (are tapered toward each other) as they extend from the outside to the inside of the ceramic base.

Both temperature tests and actual life test data indicate the improved seal cooling effects characteristic of the present invention. Seal temperature comparisons with other base types illustrate up to an 11 percent decrease in seal temperature.

In connection with the temperature tests carried out on the ceramic base, four 5K thermocouple lamps have been tested. Two of the lamps were constructed in accordance with the present invention with convective cooling vents; one was a ceramic base without cooling vents; and the other was a metal base lamp lamp.

In carrying out these tests on each of the lamps, the thermocouple was placed directly on the molybdenum cup seal for seal temperature readings. The lamps were burned in a commercial Mole Richardson fixture (Senior Solar Spot in flood mode) with temperature readings taken at one hour intervals. The results of the test are indicated in the table below:

TABLE

| Maximum Rated Seal Temperature = 475 degrees Celsius (C.) | | | |
|---|---|---|---|
| | Metal Base | Venting | No Venting |
| Reading #1 | 418° C. | 229° C. | 243° C. |
| Reading #2 | 422° C. | 233° C. | 249° C. |
| Reading #3 | 420° C. | 229° C. | 249° C. |
| Average | 420° C. | 230° C. | 247° C. |
| Difference (Of Average) | ·190° C. | ·17° C. | |

The above test results indicate a dramatic reduction in seal temperature with the improved ceramic base of this invention. The use of convective cooling vents shows a seal temperature reduction even in comparison with the all ceramic base. It is furthermore noted that because the 230° C. seal temperature is below 250° C., the press seal operating maximum temperature, this allows one to pursue a press-seal leg and thereby the relatively expensive cup seal.

While there have been shown and described what are at present considered the preferred embodiments of the invention, it will be obvious to those skilled in the art that various changes and modifications may be made therein without departing from the scope of the invention as defined by the appended claims.

We claim:

1. A tungsten halogen lamp comprising a sealed envelope of vitreous material having a bulb portion and a press sealed portion including two spaced apart sealed leg portions at one end thereof;

a pair of electrically conductive lead-in wires electrically connected at first ends to a filament structure positioned in the bulb portion of the sealed envelope; the lead-in wires sealed through the press-sealed leg portions and extending beyond the pressed-sealed portion for electric connection; and a ceramic base having a first base hole sized and positioned to accommodate and support the press-sealed portion of the sealed envelope, a pair of second base holes sized and positioned as a continuation of the first base hole to accommodate the sealed leg portions, a wall means having defined therein convective vent means including at least one first vent passage extending at an angle to the longitudinal axis of one of the second base holes for the inlet of air from outside the base to at least one of the second base holes, the wall means having at least a second vent passage extending at an angle to the longitudinal axis of the second base hole for the outlet of air from the second base hole to the outside of the base, the second vent passage being disposed apart from the first vent passage at a location closer to the bulb portion than the location of the first vent passage to provide an air circulation path from the first vent passage, thereby providing convective air cooling of the envelope press-sealed portion when the lamp is operated in an upright manner.

2. A tungsten halogen lamp as set forth in claim 1 including a pair of inlet vent passages disposed diametrically in the base wall and communicating with respective base holes.

3. A tungsten halogen lamp as set forth in claim 2 including a pair of outlet vent passages disposed diametrically in the base wall and communicating with respective base holes.

4. The tungsten halogen lamp of claim 1, wherein a lead-in wire includes a foil seal in press-sealed leg portion.

5. The tungsten halogen lamp of claim 1, wherein the ceramic base includes second base holes in part having greater size than the accommodated press-sealed leg portions thereby providing a space for air flow between the ceramic base and the accommodated press-sealed leg portions.

6. The tungsten halogen lamp of claim 5, wherein the ceramic base includes second base holes in part having greater size around a portion of the accommodated press-sealed leg portions thereby providing a space for air flow between the ceramic base and around the portion of the accommodated press-sealed leg portions.

7. The tungsten halogen lamp of claim 1, wherein the vent angle substantially inhibits radiant energy from passing directly to the press-seal.

8. The tungsten halogen lamp of claim 7, wherein the vent angle is approximately 45° to the longitudinal axis of the lamp base.

9. The tungsten halogen lamp of claim 1, wherein the one of the inlet vents is disposed adjacent an end of one of the press-seal legs farthest from the bulb portion.

10. The tungsten halogen lamp of claim 1, wherein the one of the outlet vents is disposed adjacent an end of one of the press-seal legs nearest the bulb portion.

11. The tungsten halogen lamp of claim 1, wherein the ceramic base is formed in two pieces joined to enclose the press-seal and leg portions.

12. A tungsten halogen lamp comprising a sealed envelope of vitreous material having a bulb portion and a press sealed portion including two spaced apart sealed leg portions at one end thereof;

a pair of electrically conductive lead-in wires electrically connected at first ends to a filament structure positioned in the bulb portion of the sealed envelope; the lead-in wires sealed through the press-sealed leg portions, the lead-in wires including foil seal portions in the press-sealed leg portion and extending beyond the pressed-sealed portion for electric connection; and a ceramic base having a first base hole sized and positioned to accommodate and support the press-sealed portion of the sealed envelope, a pair of second base holes sized and positioned as a continuation of the first base hole to accommodate the sealed leg portions, the second base holes in part having greater size around portions of the accommodated press-sealed leg portions thereby providing spaces for air flow between the ceramic base and around the portions of the accommodated press-sealed leg portions, a wall means having defined therein convective vent means including at least one first vent passage extending at an angle to the longitudinal axis of one of the second base holes, the vent angle substantially inhibiting radiant energy from passing directly to the press-seal, for the inlet of air from outside the base to at least one of the second base holes, and the wall means having at least a second vent passage extending at an angle to the longitudinal axis of the second base hole for the outlet of air from the second base hole to the outside of the base, the vent angle substantially inhibiting radiant energy from passing directly to the press-seal, the second vent passage being disposed apart from the first vent passage at a location closer to the bulb portion than the location of the first vent passage to provide an air circulation path from the first vent passage, thereby providing convective air cooling of the envelope press-sealed portion when the lamp is operated in an upright manner.

* * * * *